United States Patent [19]

Culbertson

Best Available Copy

[11] 4,210,382

[45] Jul. 1, 1980

[54] ELECTRICAL CONNECTOR AND HOUSING

[75] Inventor: Thomas L. Culbertson, Dearborn Heights, Mich.

[73] Assignee: Ford Motor Company, Dearborn, Mich.

[21] Appl. No.: 41,587

[22] Filed: May 23, 1979

[51] Int. Cl.[2] ..... H01R 9/16

[52] U.S. Cl. ..... 339/192 R; 339/217 S

[58] Field of Search ..... 339/217 S, 191, 192, 339/193

[56] References Cited

U.S. PATENT DOCUMENTS

| | | | |
|---|---|---|---|
| 3,271,729 | 9/1966 | Bakker et al. | 339/192 RL |
| 3,336,567 | 8/1967 | Coldren | 339/192 R |

FOREIGN PATENT DOCUMENTS

| | | | |
|---|---|---|---|
| 218137 | 3/1958 | Australia | 339/192 RL |
| 1615723 | 4/1970 | Fed. Rep. of Germany | 339/193 R |
| 773473 | 4/1957 | United Kingdom | 339/192 RL |

*Primary Examiner*—John McQuade

*Attorney, Agent, or Firm*—Peter Abolins; Clifford L. Sadler

[57] ABSTRACT

This specification discloses an electrical assembly for engaging a set of contact pins such as that extending from a power window switch. The assembly includes a one-piece housing with a passageway extending therein for receiving an electrical contact terminal. A ramp along one side of the passageway has a recess therein so that the ramp does not extend completely across the side of the passageway. The electrical contact terminal has a socket portion for receiving a contact pin, the socket portion having a raised flange for guiding the pin. The recess in the ramp is aligned to pass the raised flange thus easing entry of the terminal into the passageway and preventing such excessive deflection and deformation which would occur if the flange portion had to pass over the ramp.

5 Claims, 7 Drawing Figures

ELECTRICAL CONNECTOR AND HOUSING

BACKGROUND OF THE INVENTION

1. Field of the Invention

The present invention relates to electrical connectors and housing therefor and, more particularly, to electrical connectors to be mounted in an insulating housing for use with contact pins of an electrical switch.

2. Prior Art

It is known to terminate wire leads which are electrically conducting at a group of contact pins which are adapted to be frictionally engaged in female receptacle terminals connected by suitable leads to the rest of the circuit. A housing can secure and position the terminals for connection to the contact pins.

Some problems encountered in forming a good connection between the terminals and the contact pins include insuring a good mechanical and electrical connection will be maintained with each pin despite vibrations and various other forces which can be encountered in automobile environment. For example, the temperature and humidity can greatly vary in an automobile environment. The housing must provide electrical isolation between the individual electrical terminals therein to avoid possible short circuiting between adjacent terminals with such undesirable results as inoperative electrical components or damage to the electrical components.

Further, particularly in automobile manufacture, it is desirable to have simple, low cost and reliable manufacturing techniques which quickly produce a secure contact. There must be ease of assembly when fitting the terminal into the housing and when fitting the contact pin into the electrical assembly including the housing and terminal. It is desirable, both from the viewpoint of customer satisfaction and reducing expenses, to minimize the number of repairs necessitated by contact failure. Failure of a simple contact connection can result in the failure of the attached electrical component, such as a power window, which may cause a variety of undesirable side effects. The automobile environment also requires that the electrical assembly including housing and terminal, be both small and light weight. Often, a great many electrical components must be packed into a relatively small space, such as an arm rest which provides electrical control for four windows and various other electrical accessories. These are some of the problems this invention overcomes.

SUMMARY OF THE INVENTION

An electrical assembly which can engage a contact pin from, for example, a power window switch, includes an insulating one-piece housing and a generally U-shaped electrical contact terminal. The housing includes at least one passageway extending therein through a side surface and terminating at an end wall, the passageway being bounded by a top wall, a bottom wall, and opposed side walls. A top aperture in the top wall intersects the passageway for admitting the contact pin laterally into the passageway. A transverse ramp extends partly between the top and bottom walls and has a ledge facing the end wall and an inclined surface facing away from the end wall. The transverse ramp includes a recess extending longitudinally in the passageway across the transverse ramp. The electrical contact is longitudinally positioned within the passageway and includes a generally cylindrical socket portion having a pin receiving axis disposed laterally in the passageway in alignment with the top aperture. A forward end of the terminal is engageable with the end wall to stop its forward movement in the passageway. A ferrule portion mates to a wire lead connected to the terminal. A first leg of the U-shaped terminal extends forward from the ferrule portion to the forward end, generally forming a first side of the socket portion. A second resilient leg of the U-shaped terminal integrally extends rearward from the forward end of the first leg, generally forming a second side of the socket portion and terminating adjacent the ledge to retain the terminal in the passageway. The first and second legs have a flanged portion at the socket portion for guiding movement of the contact pin into the socket portion. The ramp extends generally parallel to the receiving axis of the socket portion and the recess is aligned to pass the flanged portion thus easing entry of the terminal into the passageway and preventing such excessive deflection and deformation which would occur if the flange portion had to pass over the ramp.

An electrical assembly in accordance with an embodiment of this invention is particularly advantageous because it can be easily assembled, is relatively inexpensive and provides a good guiding surface for the insertion of the contact pin into the terminal. The housing is particularly adapted to pass this guiding surface without deformation thus improving reliability. Without the guiding surface, that is the flange, or with a deformed flange, there is a chance that the contact pin would go between the terminal and the housing thus establishing a connection which may appear to be satisfactory initially because it passes current but which has a reduced hold on the contact pin and may permit the contact pin to come loose under extended periods of vibration. Advantageously, the passageway also has an opening for insertion of a tool to facilitate removal of the terminal. As a result, an electrical assembly in accordance with an embodiment of this invention is more reliable and easier to service than previously known connectors.

DETAILED DESCRIPTION OF THE INVENTION

Figure 1:
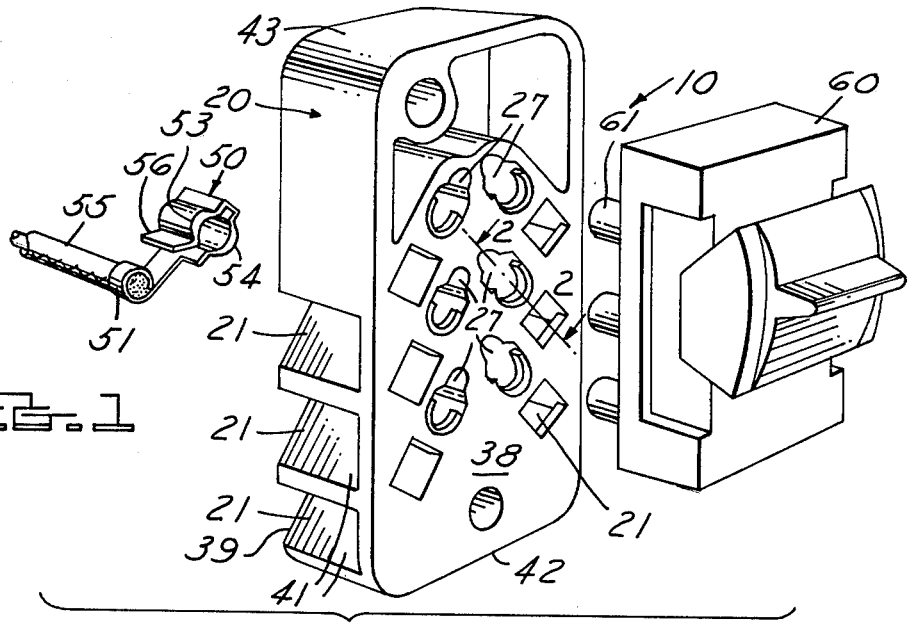
FIG. 1 is a perspective view of an electrical assembly in accordance with an embodiment of this invention including an exploded electrical contact terminal and exploded contact pin of a switch to be mated with the electrical assembly.
Figure 2:
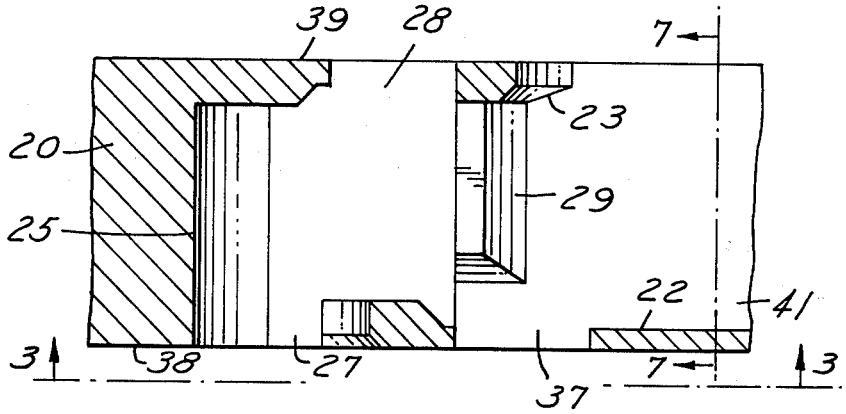
FIG. 2 is a view taken along section line 2—2 of FIG. 1.
Figure 3:
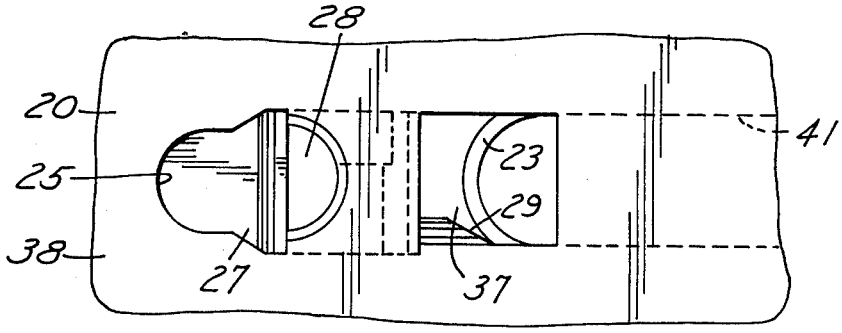
FIG. 3 is a partial bottom plan view taken along line 3—3 of FIG. 2.
Figure 4:
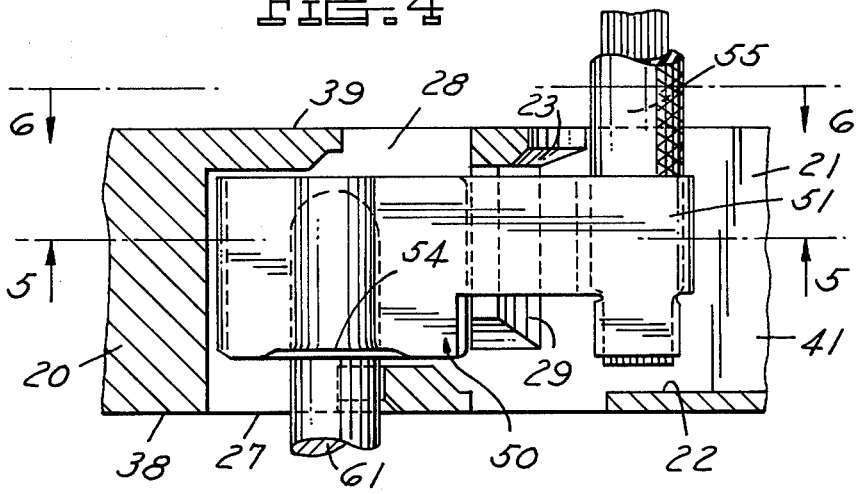
FIG. 4 is a view similar to FIG. 2 with the inclusion of a contact pin and an electrical terminal in accordance with an embodiment of this invention.
Figure 5:
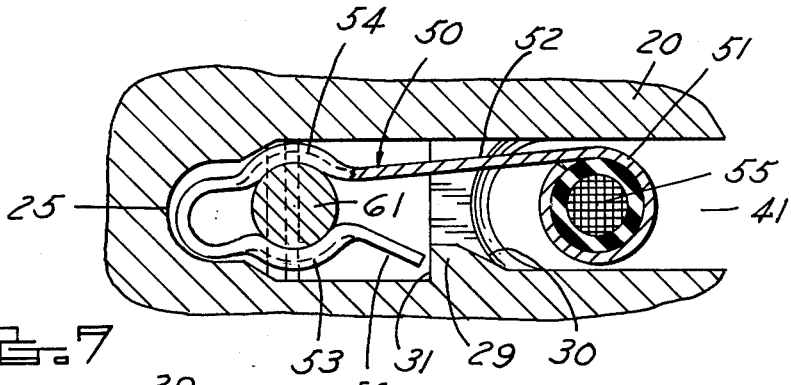
FIG. 5 is a view taken along section line 5—5 of FIG. 4.

Referring to FIG. 1, an electrical assembly 10 includes an insulating housing 20 for supporting therein five or six electrical contact terminals 50 thereby providing electrical connection to a cluster pin terminal. For example, a power window switch 60 can include five parallel, post like contact pins 61 extending from power window switch 60 for mating in electrical assembly 10. Insulating housing 20 of electrical assembly 10 is a one-piece molded plastic body of a generally rectangular shape. Passageways 21 (FIGS. 2–7) are formed at an acute angle to the longitudinal axis of the rectangular body. Passageways 21 extend only part way into housing 20 with openings or entrances 41 positioned along opposing side surfaces 40 of insulating housing 20. Housing 20 further includes a top surface 38, an opposing bottom surface 39, a front surface 42 and an opposing back surface 43. Top surface 38 of housing 20 is provided with top apertures 27 which extend into respective passageways 21 and are each adapted for receiving one contact pin 61. Bottom surface 39 of housing 20 includes bottom openings 28 which extend into respective passageways 21 for receiving a tool to facilitate removal of contact terminal 50 from housing 20.

Figure 7:
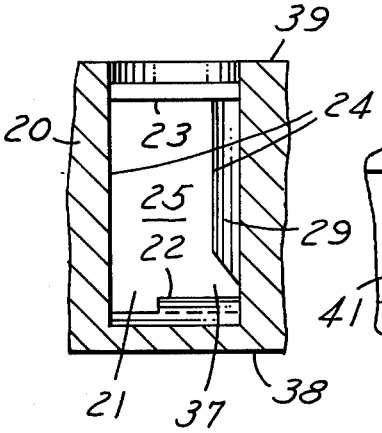
FIG. 7 is an end view taken along section line 7—7 looking down the passageway shown in FIG. 2 with a ramp shown extending partly across one side of the passageway so there is a recess for passing the flange of an electrical terminal in accordance with an embodiment of this invention.
Figure 6:
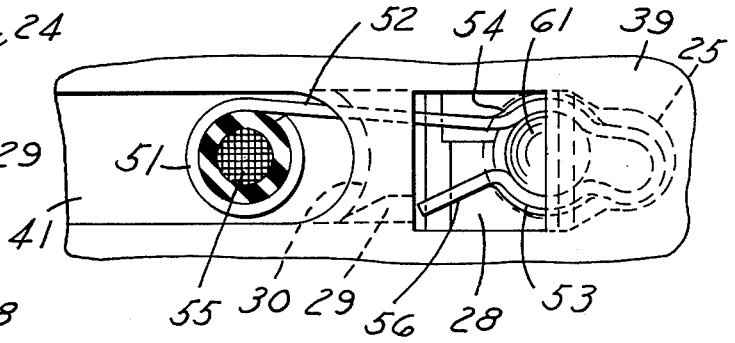
FIG. 6 is a view taken along section line 6—6 of FIG. 4.

Passageway 21 includes a top wall 22, an opposing bottom wall 23, a pair of opposing side walls 24, and a front or end wall 25 (FIG. 7). Extending along a portion of a side wall 24 between top and bottom walls 22 and 23, is a ramp 29. The ramp 29 has an inclined surface 30 facing entrance 41 and a ledge 31 facing front wall 25 of passageway 21 (FIG. 6). Ramp 29 is designed to provide a retaining stop for holding terminal 50 within housing 20. Ramp 29 does not extend continuously cross side wall 24 and includes a recess 37. As discussed further below, recess 37 facilitates the passage of a portion of terminal 50 along passageway 21.

Electrical contact terminal 50 is generally U-shaped with the free end resiliently engaging ramp 29 in passageway 21 to prevent terminal 50 from coming out of the passage. Theother end of terminal 50, a ferrule portion 51 is adapted to be crimped onto a wire 55 (FIGS. 1, 5 and 6).More specifically, a leg 52 extends forward of ferrule portion 51 and partly defines one side of a generally cylindrical socket portion 53 (FIG. 6). A leg 56 is integral with leg 52 and extends rearward from the forward most portion of leg 52 and generally forms the other side of socket portion 53. Socket portion 53 generally defines a cylindrical region with a central receiving axis for receiving therein a contact pin 61. The portions of legs 52 and 56 adjacent socket portion 53 have a flange 54 surrounding one edge of socket portion 53. Flange 54 acts as a funnel to guide contact pin 61 toward the center of socket portion 53 thereby facilitating insertion of switch 60, having a plurality of contact pins 61 into electrical assembly 10. Flange 54 is positioned on terminal 50 so that it passes through recess 37 and not over ramp 29 as terminal 50 is inserted into passageway 21. As a result, this alignment of recess 37 and flange 54 eases entry of terminal 50 into passageway 21 and prevents such excessive deflection and deformation which would occur if flange 54 had to pass over ramp 29. Legs 52 and 56 are sufficiently resilient so that they can bend toward each other as terminal 10 is inserted into passageway 21.

When terminal 50 is inserted into passageway 21, top apertures 27 for receiving contact pin 61 are aligned with socket portion 53. Thus, a contact pin 61 can be inserted into housing 20 through top aperture 27 and be electrically connected to socket portion 53 of terminal 50. Advantageously, socket portion 53 is positioned a distance sufficiently to the rear of the forwardmost portion of terminal 50 so that terminal 50 can abut against front wall 25 of passageway 21 and have top aperture 27 aligned with socket portion 53. Further, a bottom wall opening 28 is positioned along the passageway 21 so that a tool inserted into bottom opening 28 can engage leg 56 so that it can be deflected and moved clear of ramp 29 to facilitate removal of terminal 50 from passageway 51.

As a result, it is particularly advantageous that housing 20 can be formed of one piece and yet have passageways 21 with top apertures 27 and bottom openings 28 so that there is access to passageways 21 from both the top and the bottom of housing 20. Such an arrangement provides for positioning a contact pin in passageway 21 and receiving a tool for moving terminal 50. Additionally, mass production requires rapid and secure assembly of a power window switch 60 to an electrical assembly 10, and it is highly advantageous that this position provides that socket portion 53 is easily and correctly positioned within passageway 21 and that there is no deformation of socket portion 53 as it is inserted into passageway 21. Without recess 37 there is a possibility that flange 54, around socket portion 53, would be bent and thus resist insertion of contact pin 61 into socket portion 53 and insulating housing 20. Although such an insertion between housing 20 and terminal 50 could provide an electrical contact, contact pin 61 would not be as securely held as it would be if it were positioned within socket portion 53.

Various modifications and variations will no doubt occur to those skilled in the various art to which this invention pertains. For example, the particular connection of the wire to the electrical contact terminal may vary from that described herein. The use of the electrical assembly may be with switches other than power window switches. These and all other variations which basically rely on the teachings through which this disclosure has advanced the art are properly considered within the scope of this invention.

I claim:

1. An electrical assembly engageable with a contact pin comprising:

an insulating one-piece housing having a top surface, a bottom surface and opposing side surfaces extending between said top and bottom surfaces, at least one passageway extending therein through a side surface and terminating at an end wall, said passageway being bounded by a stop wall, a bottom wall and opposed sidewalls, a top aperture in said top wall intersecting sid passageway for admitting the contact pin laterally into said passageway, a transverse ramp extending partly between said top and bottom walls having a ledge facing said end wall and an inclined surface facing away from said end wall, and said transverse ramp including a recess extending longitudinally in said passageway across said transverse ramp;

a generally U-shaped electrical contact terminal for being longitudinally positioned within said passageway including a generally cylindrical socket portion having a pin receiving axis disposed laterally in said passageway in alignment with said top aperture, a forward end of said terminal being engageable with said end wall to stop forward movement in said passageway, a ferrule portion for securing a wire lead electrically connected to said terminal, a first leg of said U-shaped terminal extending forward from said ferrule portion to said forward end generally forming a first side of said socket portion, a second resilient leg of said U-shaped terminal, integrally extending rearward from the forward end of said first leg generally forming a second side of said socket portion, and terminating adjacent said ledge to retain said terminal in said passageway, and said first and second legs having a flanged portion at said socket portion for guiding movement of the contact pin into said socket portion, said ramp extending generally parallel to said pin receiving axis of said socket portion and said recess being aligned to pass said flanged portion thus easing entry of said terminal into said passageway and preventing such excessive deflection and deformation which would occur if said flanged portion had to pass over said ramp.

2. An electrical assembly as recited in claim 1 wherein said housing includes a bottom opening in said passageway aligned with said second leg so that a tool can be inserted into said passageway and engage said second leg, said bottom opening being sufficiently large so that said second leg can be deflected clear of said ramp to facilitate removal of said terminal from said passageway.

3. An electrical assembly as recited in claim 2 wherein said housing has a generally rectangular shape, and a plurality of said passageways are formed at an acute angle to the longitudinal axis of said housing, said passageways extending only part way into said housing with entrances along said side surfaces of said housing, said top and bottom surfaces being provided with top apertures and bottom openings, respectively, which extend into respective passageways.

4. An electrical assembly as recited in claim 3 wherein said housing has at least five passageways, a first of said opposing side surfaces having three entrances and a second of said opposing side surfaces having two entrances.

5. An electrical assembly as recited in claim 4 wherein said housing is made of a plastic material suitable for use in an automotive environment as a power window switch connector, the wire lead is attached at a right angle to the longitudinal extension of said terminal, and said at least five passageways each have a top aperture arranged in a first row of at least twc apertures and a parallel row of three apertures.

* * * * *